US008623157B2

(12) United States Patent
Legario et al.

(10) Patent No.: US 8,623,157 B2
(45) Date of Patent: Jan. 7, 2014

(54) STORAGE STABLE ANFO EXPLOSIVE COMPOSITIONS CONTAINING CHEMICAL COUPLING AGENTS AND METHOD FOR PRODUCING SAME

(75) Inventors: Ron Robeniol Legario, Sherbrooke (CA); Ivana Alilovic, Corbeil (CA)

(73) Assignee: ETI Canada Inc., North Bay, Ontario (CA)

( * ) Notice: Subject to any disclaimer, the term of this patent is extended or adjusted under 35 U.S.C. 154(b) by 894 days.

(21) Appl. No.: 10/646,930

(22) Filed: Aug. 25, 2003
(Under 37 CFR 1.47)

(65) Prior Publication Data

US 2005/0067075 A1 Mar. 31, 2005

(51) Int. Cl.
*D03D 23/00* (2006.01)

(52) U.S. Cl.
USPC ..... 149/109.6

(58) Field of Classification Search
USPC ..... 149/2, 46, 109.6
See application file for complete search history.

(56) References Cited

U.S. PATENT DOCUMENTS

| | | | | |
|---|---|---|---|---|
| 1,222,065 | A | 4/1917 | Brown | |
| 2,218,563 | A | 10/1940 | Taylor et al. | |
| 3,136,668 | A * | 6/1964 | Simpson et al. | 149/19.6 |
| 3,287,189 | A * | 11/1966 | Wilson et al. | 149/8 |
| 3,684,597 | A | 8/1972 | Robins et al. | |
| 3,695,947 | A | 10/1972 | Edwards et al. | |
| 4,081,299 | A | 3/1978 | Griffith | |
| 4,181,546 | A * | 1/1980 | Clay | 149/21 |
| 4,383,873 | A | 5/1983 | Wade et al. | |
| 4,514,341 | A | 4/1985 | Voigt | |
| 4,595,430 | A | 6/1986 | Baker | |
| 4,736,683 | A | 4/1988 | Bachman et al. | |
| 4,775,431 | A | 10/1988 | Mullay | |
| 4,889,570 | A | 12/1989 | Leong | |
| 4,957,569 | A | 9/1990 | Waldock et al. | |
| 5,041,177 | A | 8/1991 | Hajto et al. | |
| 5,322,576 | A | 6/1994 | Aitken et al. | |
| 5,527,498 | A * | 6/1996 | Kelley | 264/3.4 |
| 6,200,398 | B1 | 3/2001 | Bush | |
| 2001/0003767 | A1 | 6/2001 | Ito et al. | |

FOREIGN PATENT DOCUMENTS

| | | |
|---|---|---|
| GB | 2120228 | * 11/1983 |
| WO | WO02055184 | * 7/2002 |

OTHER PUBLICATIONS

Food Fats and Oils, Institute of Shortening and Edible Oils, Inc., 1999, Washington, D.C., Eighth Edition, pp. 1-41.
Fat Content and Fatty Acid Composition of Seed Oils, from Udo Erasmus' book, Website http://curezone.org/foods/fatspercent.asp. Publication date unknown.
Common (non-systematic) Names for Fatty Acids, List prepared by R.O. Adlof and F.D. Gunstone, Last updated Dec. 20, 2001, Website: http://www.aocs.org/member/division/analytic/fanames.htm.
http://www.atofinachemicals.com/additives/epox2.cfm'pages. Publication date unknown.

* cited by examiner

*Primary Examiner* — Aileen B Felton
(74) *Attorney, Agent, or Firm* — Bereskin & Parr LLP/S.E.N.C.R.L., s.r.l.; Philip C. Mendes da Costa

(57) ABSTRACT

An ANFO explosive composition includes a mixture of ammonium nitrate particles, an organic combustible fuel, and a chemical coupling agent having an aliphatic portion and an epoxy group. The chemical coupling agent may be selected from the group consisting of an epoxidized oil, an ester derivative of epoxidized oil and mixtures thereof. The use of such chemical coupling agents and a method of producing the ANFO explosive composition is also disclosed.

21 Claims, No Drawings

STORAGE STABLE ANFO EXPLOSIVE COMPOSITIONS CONTAINING CHEMICAL COUPLING AGENTS AND METHOD FOR PRODUCING SAME

FIELD OF THE INVENTION

The present invention relates to storage stable explosive compositions containing chemical coupling agents, and a method for producing same.

BACKGROUND OF THE INVENTION

Dry blasting agents, such as ammonium nitrate/fuel oil (ANFO) explosive compositions, are commonly used for blasting in open pits, underground mining, quarry and construction. As ammonium nitrate is not readily detonatable in and of itself, it is typically mixed with a carbonaceous fuel oil in order to obtain a mixture that is more or less oxygen balanced and therefore detonatable.

An ANFO explosive composition could be prepared at a mine and immediately loaded into a series of boreholes. Alternatively, it could be manufactured at a production site where it is packaged in a polyethylene or a "kraft" paper bag (e.g., having a wax lining) and stored for future use. The ANFO explosive composition would be loaded into the boreholes (typically from about 10 to 15 holes to more than about 100 holes) over a period of days. Typically, an ANFO explosive composition may be kept in a borehole anywhere from 1 hour up to 14 days prior to being detonated. If the explosive is a prepackaged ANFO explosive composition, then due to shipping and handling time, the explosive composition must be stable for extended periods of time. In some cases, the length of time between mixing the explosive composition and detonation of the explosive composition may be up to 180 days or more.

A problem that has been encountered with prior art high density ANFO explosive compositions is that the fuel oil tends to separate from the ammonium nitrate during the time that the explosive composition is stored in the borehole awaiting detonation. If the oil separates from the ammonium nitrate, the explosive composition may deflagrate or it may fail to explode.

The density of ammonium nitrate particles that are used in an ANFO explosive composition may vary widely. Higher density ammonium nitrate particles have a greater bulk density and, when mixed with fuel oil, produce a higher detonation pressure. However, as the density of the ammonium nitrate particles increases, the oil adsorption of the particles decreases. This is due to the lower porosity of higher density ammonium nitrate particles. The lower porosity results in oil migrating to the bottom of a borehole. Therefore, it is difficult to make a storage stable explosive composition with higher density ammonium nitrate prills (e.g., about 0.86 to about 1.1 g/cc, or higher).

One method to reduce oil segregation with higher density ammonium nitrate particles is to use high viscosity fuel oils. However such fuel oils are expensive, not always available in remote locations where ANFO explosives are used and require costly shipping.

SUMMARY OF THE INVENTION

The present invention provides for a chemical coupling agent for use in combination with ammonium nitrate (alone or in combination with other solid inorganic oxidizers) and an organic combustible fuel (e.g., diesel oil) in preparing a storage stable explosive composition. The chemical coupling agent is selected and present in an amount so that the explosive composition has an oil segregation factor sufficiently low to render the explosive composition detonatable, to reduce and preferably minimize the amount of toxic gases produced during detonation, and to release a sufficient amount of energy during detonation to achieve an acceptable amount of rock breaking (e.g. acceptable blast results).

The chemical coupling agent is an organic compound having a non-polar aliphatic portion capable of associating with the organic combustible fuel and a polar portion capable of associating with the solid inorganic oxidizer. The non-polar aliphatic portion comprises a long chain organic molecule that may contain from about 3 to about 24, preferably from about 10 to about 22 and most preferably from about 14 to about 18 carbon atoms. The polar portion capable of associating with the solid inorganic oxidizer comprises an epoxy group.

Without being bound by theory, it is believed that the epoxy group cross-links with, e.g., the ammonium nitrate particles according to the following reactions:

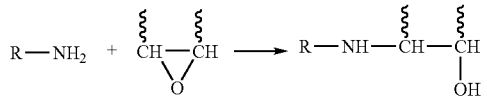

(1)

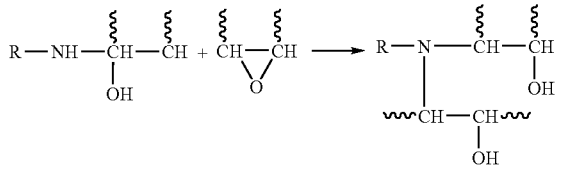

(2)

The ammonium nitrate particles contain nitrogen and hydrogen components that react with the epoxy ring thereby linking the ammonium nitrate particles to the chemical coupling agent. The non-polar aliphatic portion is soluble in the organic combustible fuel. Accordingly, the chemical coupling agent serves as a chemical bridge between the ammonium nitrate and the organic combustible fuel (preferably comprising or consisting essentially of diesel oil). The chemical coupling agent effectively acts as an intermediary to maintain the fuel oil on the surface of the ammonium nitrate particles. This reduces the amount of separation of the oil from the ammonium nitrate particles resulting in a more storage stable explosive composition (e.g., they are capable of being stored, once mixed, for an extended period of time and still be detonable with acceptable results—i.e., the by-products of detonation (e.g., volume of toxic gases released) are comparable to that produced by freshly made explosive compositions and the blasting results (e.g., amount of broken rock) for the storage stable explosive compositions are comparable to freshly made explosive compositions).

The chemical coupling agent may be an epoxidized oil or an ester derivative thereof and, preferably, an epoxidized vegetable oil or an ester derivative thereof.

Advantageously, it has been determined that the addition of the chemical coupling agent to the fuel oil does not appreciably change the viscosity of the fuel oil.

In accordance with one aspect of the instant invention, there is provided an ANFO explosive composition comprising a mixture of ammonium nitrate particles, an organic combustible fuel, and a chemical coupling agent having an aliphatic portion and an epoxy group.

In one embodiment, the chemical coupling agent is selected from the group consisting of an epoxidized oil, an ester derivative of epoxidized oil, and mixtures thereof.

In another embodiment, the chemical coupling agent is an epoxidized vegetable oil.

In another embodiment, the chemical coupling agent is an epoxidized fish oil.

In another embodiment, the chemical coupling agent is selected from the group consisting of epoxidized soybean oil, epoxidized linseed oil and mixtures thereof.

In another embodiment, the chemical coupling agent contains a plurality of epoxy groups per molecule of chemical coupling agent.

In another embodiment, the chemical coupling agent is present in an amount from about 0.1 to about 10 wt % based on the weight of the organic combustible fuel.

In another embodiment, the chemical coupling agent is present in an amount from about 1 to about 4 wt % based on the weight of the organic combustible fuel.

In another embodiment, the organic combustible fuel is present in an amount from about 5 to about 6 wt % based on the weight of the explosive composition.

In another embodiment, the organic combustible fuel comprises diesel oil.

In another embodiment, the ammonium nitrate particles have a density above about 0.86 g/cc.

In another embodiment, the ammonium nitrate particles substantially comprise mini-prills.

In another embodiment, the density of the ammonium nitrate particles is above about 1.00 g/cc.

In another embodiment, the aliphatic portion of the chemical coupling agent has from about 14 to about 18 carbon atoms.

In another embodiment, the chemical coupling agent is selected so as to produce an explosive composition that has an oil separation less than about 1%.

In another embodiment, the explosive composition comprises less than about 3 wt % water.

In accordance with another aspect, the instant invention also provides for a use of a chemical coupling agent in an ANFO explosive composition wherein the chemical coupling agent has a long chain carbon portion having from about 3 to about 24 carbon atoms and an epoxy group.

In another embodiment, the chemical coupling agent contains from 3 to 6 epoxy groups per molecule of chemical coupling agent.

In another embodiment, the chemical coupling agent contains from 4 to 5 epoxy groups per molecule of chemical coupling agent.

In another embodiment, the ANFO explosive composition comprises ammonium nitrate particles having a density above about 0.86 g/cc.

In another embodiment, the ammonium nitrate particles substantially comprise particles having diameters in a range of between about 0.5 to about 4 mm.

In another embodiment, the ammonium nitrate particles substantially comprise particles having diameters in a range of between about 0.5 to about 1.5 mm.

In another embodiment, the long chain carbon portion of the chemical coupling agent has from about 3 to about 24 carbon atoms.

In accordance with another aspect of the instant invention, there is also provided a method for producing an ANFO explosive composition, comprising:

a) providing an organic combustible fuel, ammonium nitrate particles and a chemical coupling agent having a long chain aliphatic portion and an epoxy group;

b) combining the organic combustible fuel, ammonium nitrate particles and a chemical coupling agent to produce the ANFO explosive composition.

In one embodiment, the method further comprises selecting the chemical coupling agent from the group consisting of an epoxidized oil, an ester derivative of epoxidized oil, and mixtures thereof.

In another embodiment, the method further comprises selecting epoxidized vegetable oil as the chemical coupling agent.

In another embodiment, the method further comprises selecting epoxidized fish oil as the chemical coupling agent.

In another embodiment, the method further comprises selecting a chemical coupling agent containing a plurality of epoxy groups per molecule of chemical coupling agent.

In another embodiment, the method further comprises selecting a chemical coupling agent having from 4 to 6 epoxy groups per molecule of chemical coupling agent.

In another embodiment, the method further comprises:

a) combining the organic combustible fuel and the chemical coupling agent to form a liquid mixture; and, b) combining the liquid mixture with the ammonium nitrate particles to produce the ANFO explosive composition.

In another embodiment, the method further comprises selecting diesel oil as the organic combustible fuel.

In another embodiment, the method further comprises selecting ammonium nitrate particles having a density above about 0.86 g/cc as the ammonium nitrate particles.

In another embodiment, the method further comprises selecting ammonium nitrate particles having a density above about 1.00 g/cc as the ammonium nitrate particles.

In another embodiment, the method further comprises selecting a compound having an aliphatic potion with from about 14 to about 18 carbon atoms as the chemical coupling agent.

In another embodiment, the method further comprises combining a sufficient amount of chemical coupling agent in the ANFO explosive composition such that the ANFO explosive composition has an oil separation less than about 1%.

These and other advantages of the present invention may be understood by the following description of a preferred embodiment of the invention.

DETAILED DESCRIPTION OF THE INVENTION

The explosive compositions of the present invention comprise an explosive mixture of ammonium nitrate particles, an organic combustible fuel and a chemical coupling agent.

In accordance with one aspect of the instant invention, the ammonium nitrate particles be used as the sole solid inorganic oxidizer or it may be used in combination with other nitrates, perchlorates or other inorganic oxidizers. Particulate ammonium nitrates suitable for use in ANFO blasting explosives are known in the art and any such particulate forms may be used. Suitable ammonium nitrate particles may be in the form of separate discrete particles such as prills, granules, crystals, pellets and fines. The ammonium nitrate particles may be of high density (e.g., 0.86-1.1 g/cc or higher), which are of a low porosity (e.g., absorbs less than about 6% oil) or low density (e.g., 0.6-0.85 g/cc), which are of a higher porosity (e.g., absorbs about 6% or more of oil).

The particulate ammonium nitrates which may be used pursuant to this invention are even those which, in conventional ANFO explosive compositions, would produce an ANFO explosive composition having unacceptable levels of oil segregation. Such particles have a low power of oil adsorption and/or a low power of oil absorption. The factors that affect the oil adsorption of particulate ammonium nitrate include the porosity of the ammonium nitrate, the coating, if any, on the surface of the ammonium nitrate particle and the surface area of the ammonium nitrate particle. As the porosity and the surface area of ammonium nitrate particles decrease, the absorbability of the particles decreases. Further, certain coatings tend to decrease the absorbability of the ammonium nitrate particles. Thus even ammonium nitrate particles having a high porosity may benefit from this invention if the particles have been coated.

In one aspect of the invention, the ammonium nitrate particles substantially comprise porous low-density prills. The untamped bulk density of porous low density prills is generally from about 0.60 to about 0.85 g/cc, as determined by weighing an untamped sample of the prills in a container of known volume as is known in the art.

In accordance with another aspect of the instant invention, the ammonium nitrate particles preferably comprise high-density prills such as agricultural ammonium nitrate prills (having diameters ranging from between about 1.5 mm to about 3 mm), or smaller size high-density prills commonly referred to as "mini-prills" (having diameters ranging from between about 0.46 mm to about 1.5 mm), or mixtures thereof. The untamped bulk density of the high density ammonium nitrate prills may be generally from about 0.86 to about 1.1 g/cc or more and, preferably, from about 0.90 to about 1.1 g/cc or more,_more preferably, from about 0.95 to about 1.07, and most preferably greater than about 1.0 g/cc_as determined by weighing an untamped sample of the prills in a container of known volume. The high density mini-prills provide a high particle surface area and uniformity in particle shape. The high density mini-prills allow for dense particle packaging while retaining sufficient air void spaces between the explosive particles to permit the mixture to function effectively as an explosive. Furthermore, the high density mini-prills provide greater amounts of the ammonium nitrate per unit volume of the explosive, further increasing the total energy release and explosive velocities of the explosive composition.

In accordance with another aspect of the instant invention, the ammonium nitrate particles comprise a mixture of high density prills (e.g., agricultural ammonium nitrate prills and/or mini-prills as described above) and low density prills.

A portion of the solid inorganic oxidizer in the ANFO explosive composition may be any other solid inorganic oxidizers known in the art including alkali metal nitrates and perchlorates (such as sodium nitrate and potassium nitrate) or alkaline-earth metal nitrates and perchlorates (such as calcium, magnesium and barium nitrates). These additional components will generally be added in amounts from about 0 to about 20 wt % and, more preferably, from about 0 to about 15 wt % based upon the weight of the ammonium nitrate.

It is preferred that the ammonium nitrate is coated with an anti-caking agent. Ammonium nitrate coatings and the amounts used are known in the art.

The organic combustible fuel may be selected from any fuel oil known in the art. Examples include, but are not limited to, fuel oil, heating oil, diesel fuel, jet fuel, kerosene, mineral oils, corn oil, soybean oil, saturated fatty acids such as lauric acid and stearic acid, and alcohols such as cetyl alcohol, and the like. Such fuels may also be supplemented with fuel-soluble ingredients such as glucose, mannose, fructose, waxes, such as microcrystalline wax, paraffin wax, petroleum wax and the like. Preferably, the organic combustible fuel comprises a fuel oil and, more preferably, diesel oil.

The explosive composition used in the present invention preferably contains sufficient fuel oil so that the explosive composition is essentially oxygen-balanced, as is known in the art. Preferably, the organic combustible fuel is present in an amount from about 4 to 7 wt % based on the weight of the explosive composition, more preferably from about 4 to 6 wt %, and most preferably about 5 to 6 wt %. As the chemical coupling agent is also a fuel, then the amount of fuel oil which is added to the oxidizer to form an ANFO explosive is adjusted bearing in mind the amount of fuel provided by the coupling agent so that the ANFO explosive composition has the desired amount of fuel per unit of oxidizer.

The chemical coupling agent is selected and present in an amount such that the explosive composition has an oil settlement factor sufficiently low to render the explosive composition (1) detonatable after storage for the required time, (2) stable enough to produce an acceptable volume of toxic gases during detonation, and (3) stable enough to release sufficient amounts of energy during detonation that will result in an acceptable amount of rock breaking.

The chemical coupling agent comprises an epoxy or oxirane ring and a long chain carbon skeleton and is preferably either an epoxidized oil or an ester derivative thereof. The chemical coupling agents used in the present invention are preferably substantially water-insoluble.

The epoxidized oil used in the present invention can be derived from any oil that is unsaturated (e.g., has at least one double bond linkage between two carbon atoms in a fatty acid) and capable of forming an oxirane group. Any suitable epoxidation technique as is well known in the art can be used.

In a preferred embodiment, the chemical coupling agent is selected from a group consisting of epoxidized vegetable oil and ester derivatives thereof and epoxidized fish oil and ester derivatives thereof. According to this embodiment, the chemical coupling agent may be a glyceride. Accordingly, the chemical coupling agent comprises a plurality of epoxy groups and a plurality of aliphatic portions. According to this embodiment, the chemical coupling agent preferably contains from 3 to 6, more preferably from 4 to 5, and most preferably from 4.2 to 4.5 epoxy groups per molecule of epoxidized oil.

The fatty acid composition of the chemical coupling agent can be determined by gas chromatography as is well known in the art. Preferably, the chemical coupling agent contains at least 50 wt % monounsaturated and polyunsaturated fatty acids based on the weight of the aliphatic portion of the chemical coupling agent, more preferably at least 60 wt %, and most preferably at least 70 wt %. Preferably, the chemical coupling agent comprises at least 30 wt % polyunsaturated fatty acids based on the weight of the aliphatic portion of the chemical coupling agent, more preferably at least 40 wt %, and most preferably at least 50 wt % polyunsaturated fatty acids.

The chemical coupling agent can be selected from the following group of compounds, including, but not limited to, epoxidized hemp oil, epoxidized chia oil, epoxidized kukui oil, epoxidized flax oil, epoxidized pumpkin oil, epoxidized soybean oil, epoxidized walnut oil, epoxidized wheat germ oil, epoxidized evening primrose oil, epoxidized safflower oil, epoxidized sunflower oil, epoxidized grape oil, epoxidized corn oil, epoxidized sesame oil, epoxidized rice bran oil, epoxidized cottonseed oil, epoxidized canola oil, epoxidized peanut oil, epoxidized almond oil, epoxidized olive oil, epoxidized avocado oil, epoxidized beech oil, epoxidized brazil oil, epoxidized pecan oil, epoxidized pistachio oil, epoxidized hickory oil, epoxidized filbert oil, epoxidized macademia oil, epoxidized cashew oil, epoxidized neem oil, epoxidized palm oil, epoxidized mid oleic sunflower oil, and epoxidized linseed oil. This group of compounds contains at least 50 wt % monounsaturated and polyunsaturated fatty acids based on the weight of the aliphatic portion of the chemical coupling agent.

In a preferred embodiment, the chemical coupling agent is selected from the group consisting of epoxidized hemp oil, epoxidized chia oil, epoxidized kukui oil, epoxidized flax oil, epoxidized pumpkin oil, epoxidized soybean oil, epoxidized walnut oil, epoxidized wheat germ oil, epoxidized evening primrose oil, epoxidized safflower oil, epoxidized sunflower oil, epoxidized grape oil, epoxidized corn oil, epoxidized cottonseed oil, and epoxidized linseed oil. This group of compounds has at least 50 wt % polyunsaturated fatty acids based on the weight of the aliphatic portion of the chemical coupling agent.

In a preferred embodiment, the chemical coupling agent is present in an amount from about 0.1 to about 10 wt % based on the weight of the fuel oil, and more preferably from about 1 to about 4 wt %.

The explosives of this invention are preferably substantially dry, that is, the explosives preferably contain less than about 3 wt % water, more preferably less than about 1 wt % water, and most preferably less than about 0.5 wt % water.

Various additives that are conventionally used in the art may be incorporated into the ANFO explosive compositions of this invention to improve sensitivity, density, flowability, stability and energy. For example, energy increasers such as aluminum, magnesium, aluminum-magnesium alloys, ferrophosphorus, ferrosilicon, lead and its salts and trinitrotoluene may be added. Suitable sensitizers include glass microspheres and other standard air entraining agents. Water blocking agents such as guar gum may be applied as a coating to the ammonium nitrate as taught in U.S. Pat. No. 4,889,570.

The compositions of the present invention can be formulated by combining the ammonium nitrate particles, the fuel oil, and the chemical coupling agents together and mixing them until the ammonium nitrate particles are coated with the fuel oil/chemical coupling agent. The explosive compositions of the present invention may be made by any continuous, semi-continuous or batch process that is currently used to make ANFO explosive compositions. The chemical coupling agent is added to the fuel oil, and then the two components are mixed until the chemical coupling agent is generally evenly distributed in the fuel oil. The fuel oil/chemical coupling agent mixture is then combined and mixed with the ammonium nitrate particles to distribute the fuel oil/chemical coupling agent mixture over the surface of the particles. Any of the above optional additives that are to be incorporated into the composition may be added simultaneously with, or subsequent to, the fuel oil/chemical coupling agent mixture. After the mixture is prepared, the explosive may be loaded into a borehole. Alternatively, the mixture may be packaged into a "kraft" paper bag (e.g., having a wax lining) or a polyethylene bag and stored for future use.

While the ANFO explosive compositions of the instant invention may be used by themselves, these explosives may be blended with emulsion explosives or water gel explosives as is known in the art.

Oil settlement is measured by mixing 94 wt % of high density ammonium nitrate with 6 wt % of the fuel oil based on the weight of the total composition to be tested. Prior to mixing, 3 drops of oil-soluble dye, if any, and a chemical coupling agent, if any, are added to the fuel oil. The ammonium nitrate and fuel oil are mixed and poured into a 5 liter stainless steel container. Using a wood or plastic stirrer, the ingredients are mixed until a uniform coloration is achieved throughout the composition. Typically, if manual mixing is utilized, this takes approximately 3 minutes of mixing. The composition is poured into a 500 cc graduated plastic cylinder. The mixture is added to the cylinder so as to cause the composition to completely fill the entire volume of the cylinder. When the cylinder is full, an airtight plastic seal is placed on the top of the cylinder to prevent oxidation or evaporation of the oil.

The cylinder is then placed in a constant temperature storage facility and allowed to stand for a specified storage period (e.g., 1 day, 2 days, 7 days, or 15 days). After each period of storage at a constant temperature, the plastic seal is broken and a first 20 gram sample is taken from the top of the cylinder. A second 20 gram samples is taken from the bottom of the cylinder. The samples are analyzed for oil content using ether extraction (ASTM A-4224). The oil settlement is determined by taking the difference between the percent oil content of the bottom sample and the percent oil content of the top sample.

Preferably, the chemical coupling agent is selected such that the oil settlement is less than about 2%, and more preferably, less than about 1% at the temperature at which the explosive will be stored.

The invention will be further understood by the following examples that are not to be construed as a limitation on the invention. Those skilled in the art will appreciate that other and further embodiments are obvious and within the spirit and scope of this invention from the teachings of the present examples taken with the accompanying specification.

Example 1

The oil settlement for high density ANFO explosive compositions prepared in accordance with the present invention were compared with high density ANFO explosive compositions not containing the chemical coupling agents described herein. The different high density ANFO explosive compositions that were prepared are set out in Table 1 below. The tests were conducted in accordance with the procedure set out earlier in the disclosure, tested after 7 days in storage.

TABLE 1

| Sample # | Composition of the Oil Phase (Weight %) | Oil Content - Top % | Oil Content - Bottom % | Oil Settlement % (Δ oil content bottom % less oil content top %) |
|---|---|---|---|---|
| 1 | 100% Low viscosity paraffinic oil | 3.67 | 10.70 | 7.03 |
| 2 | 100% Diesel oil | 2.75 | 9.97 | 7.22 |
| 3 | 97% Diesel oil and 3% soybean oil | 3.43 | 10.87 | 7.44 |
| 4 | 97% Diesel oil and 3% epoxidized soybean oil | 4.82 | 6.71 | 1.89 |
| 5 | 97% Diesel oil and 3% 2-ethylhexyl ester of epoxidized soybean oil | 4.12 | 6.09 | 1.97 |
| 6 | 97% diesel oil and 3% epoxidized linseed oil | 4.78 | 7.02 | 2.24 |

As can be seen, the high density ANFO explosive compositions prepared in accordance with the present invention (e.g., Samples 4-6) showed a significant reduction in oil settlement percent compared with the high density ANFO explosive compositions not containing the chemical coupling agents (e.g., Samples 1-3).

Example 2

The effect of temperature on oil settlement was measured by repeating the procedure of Example 1, while varying the storage temperature. The results are set out in Table 2.

TABLE 2

| Sample # | Composition of Oil Phase (Weight %) | Storage Temperature (° C.) | Oil Settlement % |
|---|---|---|---|
| 1 | 100% Diesel | 5 | 8.5 |
| 2 | 100% Diesel | 20 | 6.5 |
| 3 | 100% Diesel | 35 | 5 |
| 4 | 100% Paraffinic Oil* | 5 | 4.0 |
| 5 | 100% Paraffinic Oil* | 20 | 3.0 |
| 6 | 100% Paraffinic Oil* | 35 | 3.0 |
| 7 | 97% Diesel Oil & 3% Epoxidized Soybean Oil | 5 | 0.5 |
| 8 | 97% Diesel Oil & 3% Epoxidized Soybean Oil | 20 | 0.5 |
| 9 | 97% Diesel Oil & 3% Epoxidized Soybean Oil | 35 | 1.0 |

*oil viscosity 7 to 9 cSt @ 40° C.

As can be seen, the high density ANFO explosive compositions prepared in accordance with the present invention (e.g., Sample 7-9) showed a significant reduction in oil settlement % over the temperature range tested as compared with the ANFO explosive compositions not containing the chemical coupling agents (e.g., Samples 1-6).

The invention claimed is:

1. A method for reducing oil segregation in an ANFO explosive composition and using the ANFO explosive composition, comprising:

a) providing an ANFO explosive suitable organic combustible fuel, inorganic oxidizer particles comprising ammonium nitrate particles and a chemical coupling agent having a long chain aliphatic portion and an epoxy group;

b) combining the organic combustible fuel and the chemical coupling agent to produce a liquid mixture and then combining the liquid mixture with the inorganic oxidizer particles to produce a flowable ANFO explosive consisting of inorganic oxidizer particles coated with the liquid mixture and one or more conventional additives;

c) placing the flowable ANFO explosive in a borehole; and, d) maintaining the ANFO explosive as flowable until detonation.

2. The method as claimed in claim 1 further comprising selecting the chemical coupling agent from the group consisting of an epoxidized oil, an ester derivative of epoxidized oil, and mixtures thereof.

3. The method as claimed in claim 2 further comprising selecting epoxidized vegetable oil as the chemical coupling agent.

4. The method as claimed in claim 2 further comprising selecting epoxidized fish oil as the chemical coupling agent.

5. The method as claimed in claim 1 further comprising selecting a chemical coupling agent containing a plurality of epoxy groups per molecule of chemical coupling agent.

6. The method as claimed in claim 1 further comprising selecting a chemical coupling agent having from 4 to 6 epoxy groups per molecule of chemical coupling agent.

7. The method as claimed in claim 1 further comprising selecting diesel oil as the organic combustible fuel.

8. The method as claimed in claim 1 further comprising selecting ammonium nitrate particles having a density above about 0.86 g/cc as the ammonium nitrate particles.

9. The method as claimed in claim 1 wherein the ammonium nitrate particles substantially comprise particles having diameters in a range of between about 0.5 to about 4 mm.

10. The method as claimed in claim 1 wherein the ammonium nitrate particles substantially comprise particles having diameters in a range of between about 0.5 to about 1.5 mm.

11. The method as claimed in claim 1 further comprising selecting ammonium nitrate particles having a density above about 1.00 g/cc as the ammonium nitrate particles.

12. The method as claimed in claim 1 further comprising selecting a compound having an aliphatic potion with from about 14 to about 18 carbon atoms as the chemical coupling agent.

13. The method as claimed in claim 1 further comprising combining a sufficient amount of chemical coupling agent in the ANFO explosive composition such that the ANFO explosive composition has an oil separation less than about 1%.

14. The method as claimed in claim 1 wherein step (a) comprises providing the inorganic oxidizer particles and the organic combustible fuel in a weight ratio of about 94 to 6.

15. The method as claimed in claim 1 wherein step (a) comprises selecting at least one of fuel oil, heating oil, diesel fuel, jet fuel, kerosene, mineral oil, corn oil, saturated fatty acids and an alcohol as the organic combustible fuel.

16. The method as claimed in claim 1 wherein step (a) comprises selecting diesel fuel as the organic combustible fuel.

17. The method as claimed in claim 1, wherein when the organic combustible fuel, ammonium nitrate particles, and chemical coupling agent are combined, the epoxy group is in an unopened state.

18. The method as claimed in claim 1, further comprising detonating the flowable ANFO explosive.

19. The method as claimed in claim 1, wherein step (d) has a duration of between 1 hour and 14 days.

20. The method as claimed in claim 1, further comprising storing the flowable ANFO explosive prior to placing the flowable ANFO explosive into the borehole.

21. The method as claimed in claim 1, wherein during step (d), the flowable ANFO explosive exhibits an oil separation of less than 1%.

* * * * *